US009019053B1

(12) United States Patent
Contreras et al.

(10) Patent No.: US 9,019,053 B1
(45) Date of Patent: Apr. 28, 2015

(54) MULTI-POSITION MAGNETIC ROTARY SWITCH

(71) Applicants: Raymond Contreras, Forked River, NJ (US); Bern Maziar, Freehold, NJ (US)

(72) Inventors: Raymond Contreras, Forked River, NJ (US); Bern Maziar, Freehold, NJ (US)

( * ) Notice: Subject to any disclaimer, the term of this patent is extended or adjusted under 35 U.S.C. 154(b) by 0 days.

(21) Appl. No.: 14/101,008

(22) Filed: Dec. 9, 2013

(51) Int. Cl.
*H01H 9/00* (2006.01)
*H01H 3/08* (2006.01)
*H01H 3/50* (2006.01)

(52) U.S. Cl.
CPC . *H01H 3/08* (2013.01); *H01H 3/50* (2013.01); *H01H 2003/506* (2013.01)

(58) Field of Classification Search
USPC ..... 335/206
See application file for complete search history.

(56) References Cited

U.S. PATENT DOCUMENTS 4,022,078 A * 5/1977 Malott ..... 74/473.3
4,199,747 A * 4/1980 Miller et al. ..... 340/456
4,380,938 A * 4/1983 Olson ..... 74/473.11
4,660,430 A * 4/1987 Bortfeld et al. ..... 74/335
4,883,025 A * 11/1989 Richeson, Jr. ..... 123/90.11
4,887,702 A * 12/1989 Ratke et al. ..... 477/96
4,893,652 A * 1/1990 Nogle et al. ..... 137/596.17
4,899,619 A * 2/1990 Melnik et al. ..... 74/625
5,078,242 A * 1/1992 Ratke et al. ..... 477/96
5,142,928 A * 9/1992 Buti et al. ..... 74/335
5,243,871 A * 9/1993 Weiten ..... 74/473.12
5,453,732 A * 9/1995 Takano ..... 340/456
5,677,658 A * 10/1997 Osborn et al. ..... 335/228
6,073,509 A * 6/2000 Salecker et al. ..... 74/335
6,244,127 B1 * 6/2001 Benda et al. ..... 74/473.15
6,382,045 B1 * 5/2002 Wheeler ..... 74/473.12
6,415,677 B1 * 7/2002 Skogward ..... 74/473.12
6,676,564 B2 * 1/2004 Gruden ..... 477/96
8,752,448 B2 * 6/2014 Giefer et al. ..... 74/473.12
2008/0129431 A1 * 6/2008 Onodera et al. ..... 335/205

* cited by examiner

*Primary Examiner* — Shawki S Ismail
*Assistant Examiner* — Lisa Homza
(74) *Attorney, Agent, or Firm* — Charles I. Brodsky

(57) ABSTRACT

A multi-position rotary switch whose handle is rotatable to a selected position to actuate a circuit for an electrically controlled device utilizing a magnetic sensor to initiate the actuating signal without any direct contact of traditional mechanical parts that suffer wear during repetitive operations.

10 Claims, 4 Drawing Sheets

MULTI-POSITION MAGNETIC ROTARY SWITCH

CROSS-REFERENCE TO RELATED APPLICATIONS

None.

STATEMENT REGARDING FEDERALLY SPONSORED RESEARCH OR DEVELOPMENT

Research and development of this invention and application have not been federally sponsored, and no rights are given under any Federal program.

REFERENCE TO A MICROFICHE APPENDIX

Not Applicable

BACKGROUND OF THE INVENTION

1. Field of the Invention

This invention relates to the operation of large off-highway vehicles such as moving trucks, long haul trucks, mining trucks and dump trucks employing tires, for example, as large as feet tall, in general, and to a diesel electric motor operation utilized to control the wheels of such vehicles into forward, reverse and neutral manners of movement.

2. Description of the Related Art

With such vehicles frequently being used 24 hour/day, 7 days/week, reliable switch regulation is critical. Whether the switch control be located on a dashboard of a vehicle or alongside the driver's seat, anything less than long-time performance of the switch can result not only in an added cost of replacement, but in the more important taking of the vehicle off-line while a replacement switch is obtained and set to proper use. As will be appreciated by those skilled in the art, a usual control for this is one available from the General Electric Company as an SBM switch employing traditional electro-mechanical components. Although used for many years, such switches are characteristically known to wear from physical contact requiring regular replacement, yet their implementation still continues today.

OBJECTS OF THE INVENTION

It is an object of the present invention, therefore, to provide a 3-position switch able to actuate a circuit for the electronic control of these type wheels in forward, reverse, and neutral modes without using the electro-mechanical components which typify the prior art.

It is an object of the invention, also, to provide such a multi-position rotary switch available for future usage in providing more than the 3-standard positions available for these forward-reverse-neutral electro-haul vehicle implementations.

It is another object of the invention to provide a multi-position rotary switch which is substantially free of physical contact in its operation so as to thereby extend the life of the switch in its intended applications of use.

It is a further object of the invention to provide a multi-position rotary switch of this nature that will be competitive in price with the electro-mechanical rotary switches presently employed for these wheel controls in truck, rail or like industrial equipment.

It is yet another object of the invention to provide this switch for more general applications requiring a large number of repetitive operations with positive positioning on each operation.

SUMMARY OF THE INVENTION

As will be appreciated, multi-position rotary switch devices for vehicular uses are each coupled with a relay to conduct the required control voltage to the vehicle's transmission. Accordingly, the multi-position rotary switch of the invention utilizes a magnetic sensor to initiate the control without any direct contact of parts that could suffer from wear. As such, the switch will also be quite useful in the steel mill, petroleum, chemical plant and similar heavy industries where thousands of operations with positive positioning are required per week.

Although "reed-type" magnetic switches are utilized in a preferred embodiment of the invention, it will be understood that they are just common names for switches that are actuated magnetically and are normally open-circuited in usage. As set forth in the description that follows, this preferred embodiment employs a "cam" with eight lobes designed to index at 45° positions, along with spring loaded followers to provide a positive indent at each selected position location. For the "forward", "reverse", and "neutral" positions for an indicated rear wheel usage, 3 such "reed switches" are utilized.

BRIEF DESCRIPTION OF THE DRAWINGS

These and other features of the invention will be more clearly understood from a consideration of the following description, taken in connection with the accompanying drawings, in which.

DETAILED DESCRIPTION OF THE INVENTION

Figure 5:
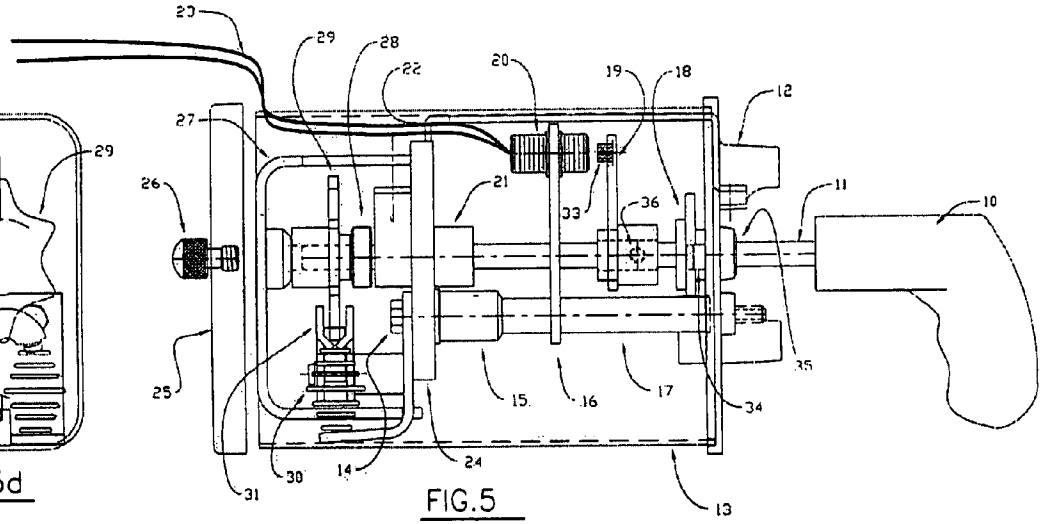
FIGS. 5, 5*a*, 5*b*, 5*c* and 5*d* are views helpful in an understanding of the "reed-type" magnetic switch and "cam" operation to actuate the levers and contacts in coupling the electrical voltages to the corresponding relays or similar devices in energizing the contractors to operate the electric motors in the drive wheels at the rear of a vehicle being driven.
Figure 5D:
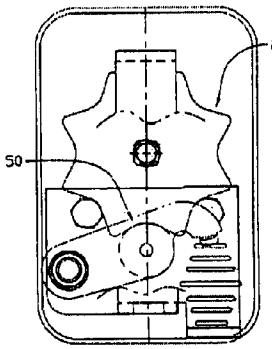
Figure 5C:
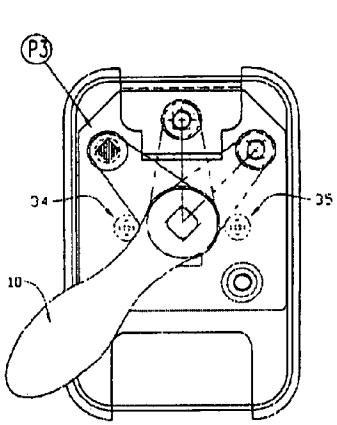
Figure 5B:
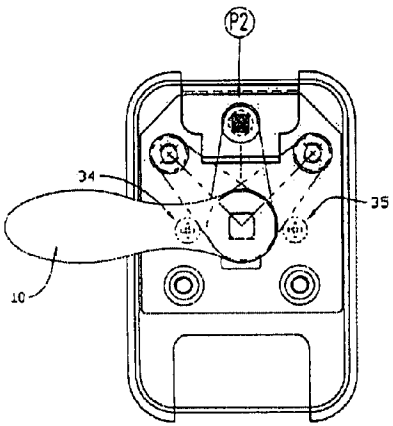
Figure 5A:
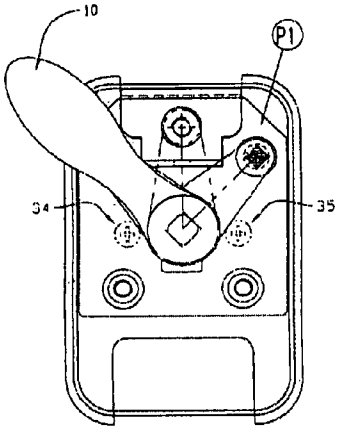

In the drawings for a 3-position rotary switch, a handle 10 is grasped and rotated to a selected position at 45° increments P1, P2 P3 (FIGS. 5*a*, 5*b* and 5*c*). The handle 10 is journalled or attached to a shaft 11 with a profile (preferably "square") at one end that synchronizes the movement of the handle 10 with a spring loaded cam 29 of 8 lobe configuration at an opposite end (FIG. 5*d*). Such synchronized movement positions an arm 19 carrying a small magnet 33 into an orientation to close an internal circuit in one of three reed-type proximity switches 20 (FIGS. 1 and 2) in creating a circuit that is connected to a control or pilot device to send the electrical signal required for the various operations of the electric truck, rail or other industrial equipment in use. As will be appreciated, the top view of FIG. 2 shows three such proximity switches 20 with connections to such equipment by wire pairs of output conductors shown at 100, 101 and 102. (The side view of FIG. 1 shows one such switch 20 with its output conductor wire pair at 23.)

In operation, the arm 19 with the magnet 33 attached follows the movement of the handle 10 and in each P1, P2 and P3 position shown in FIGS. 5*a*, 5*b* and 5*c* locates the magnet 33 over one of the three reed magnetic switches 20 causing the closure of the circuit for that position. Such circuit then closes a relay by means of the wires 100, 101, 102 attached to each individual switch to allow the electrical signal impulse to couple to the corresponding rear wheel or other equipment controls. (In this respect, and for a 3-position rotary switch for controlling the rear wheels of a large off-highway vehicle, for example, the P1 position may be selected for the "forward" movement of the wheels, the P2 position for "neutral", and the P3 position for "reverse".)

Figure 1:
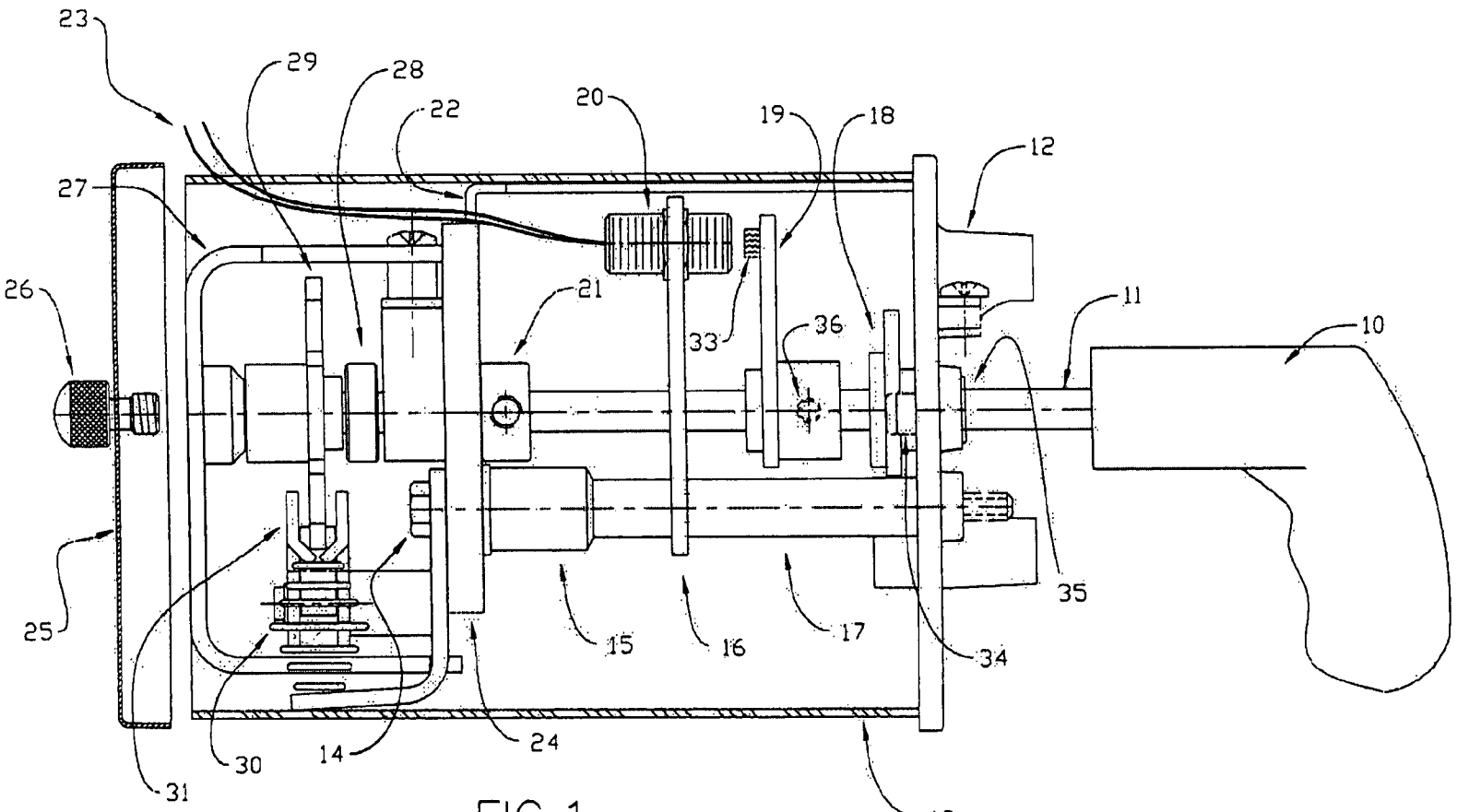
FIG. 1 is a side view of a multi-position magnetic rotary switch constructed in accordance with the teachings of the present invention.
Figure 2:
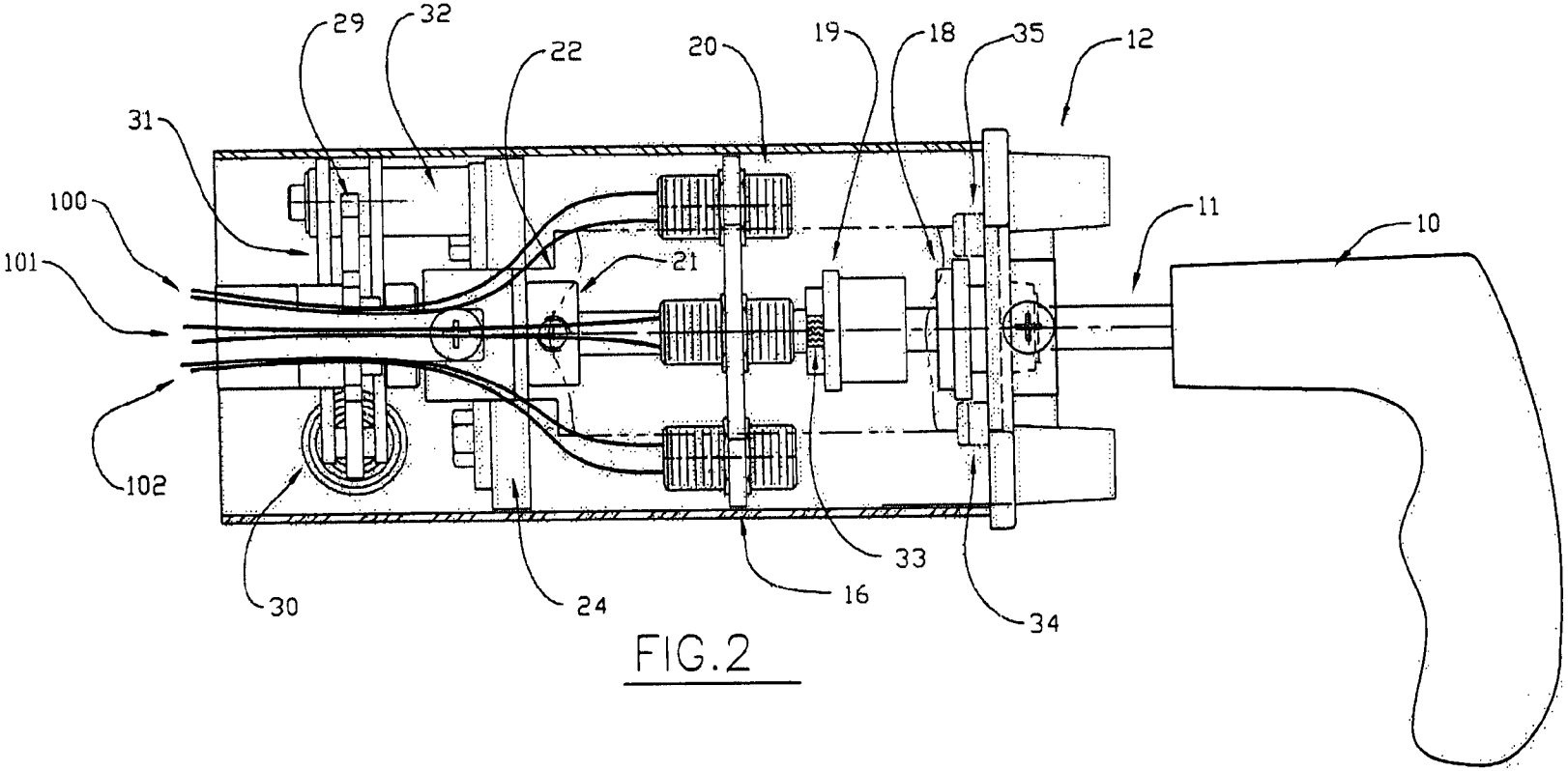
FIG. 2 is a top view of a 3-position magnetic rotary switch according to the invention.
Figure 3:
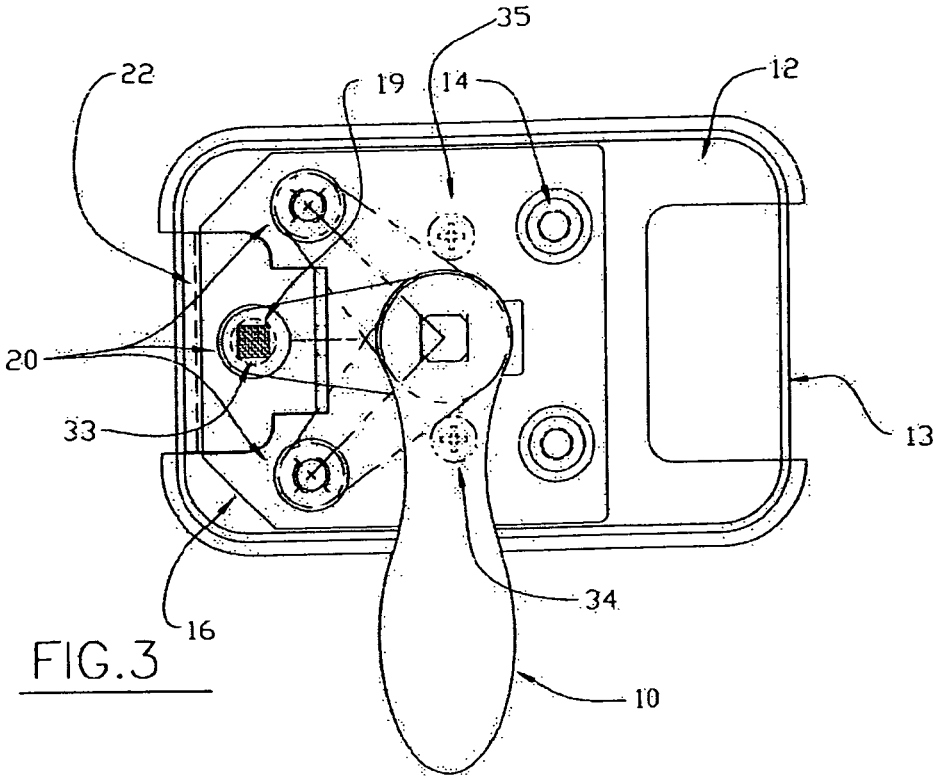
FIG. 3 is a front view of the multi-position magnetic rotary switch of FIG. 2.
Figure 4:
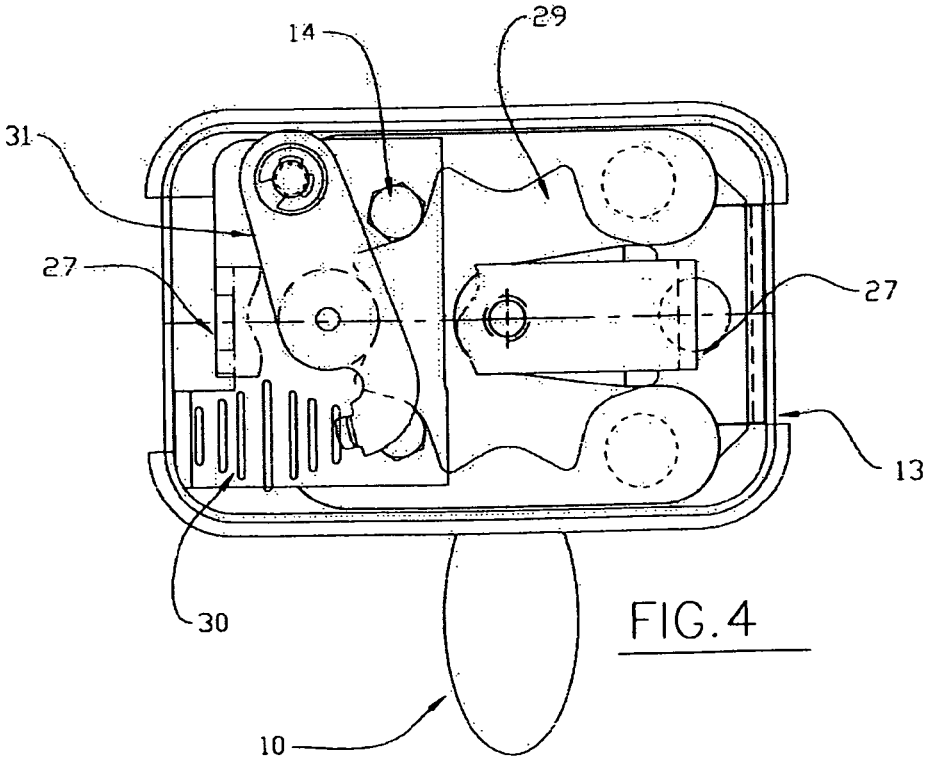
FIG. 4 is a rear view of the multi-position magnetic rotary switch of FIG. 3.

As further shown in FIGS. 1, 2 and 5, the 3-position rotary shaft is rigidly secured vertically using two sets of spacers at the bottom 15 (a large back spacer), and 17 (a front spacer), along with a reed switch mount plate 16 connected together by a tie bolt 14 to a metal mount plate 12. A top frame plate 22 shown in FIGS. 1 and (in phantom in FIG. 2) is securely anchored to the front and rear plates 24 with machine screws. A stop collar 21 prevents the shaft 11 from moving out of position horizontally while maintaining the prescribed distance between the arm 19 and the proximity switch 20. Such stop collar 21 is adjustable by a loosening to slide and control the gap between the arm and the switch, preferably over a distance 0.1 to 0.5 inch in the operating range recommended by the manufacturer of the proximity switch employed. In usage, the collar 21 is positioned so as to insure the operation of the assembly with respect to the framework dimensions of the rotary switch.

A front stop finger 18 shown in FIGS. 1, 2 and 5 is keyed to the shaft 11 in providing both lateral (left-to-right) position as well as a defining stop for the extreme positions determined by the number of indexes or positions used. On either side of the finger 18, a large thick washer is employed joined by a pair of small screws to prevent turning of the handle 10 any further than the 45° increments of FIGS. 5*a*, 5*b* and 5*c*, with the "neutral" position being that shown at P2. Such screw positioning, shown at 34 and 35 in FIGS. 5*a*-5*c*, serves to allow the lobes of the cam 29 to index at the 45° desired position. A follower 31 and spring 30 on a rear frame support 27 serve to provide a positive indent for the lobes of the cam 29 at each selected position. The spring load on the follower serves to indent a male part of the follower into a female lobe of the cam (as at 50 in FIG. 5*d*) to index its positioning and to simultaneously provide the required tension to prevent its free running. Although not shown as such, it will be understood that within the follower 31 is a roller mechanism that matches to the contour of the lobe indent in the cam. The end result that follows is that turning of the handle 10 overcomes the tension of the spring 30 so that when the next handle position is reached, the spring 30 forces the follower 31 into the 45° position in providing the orientation for the alignment to the switch. A pivot shaft as to this is shown at 32 in FIG. 2.

In construction, knurled screws 36 hold the magnetic arm 19 onto the preferably square shaft 11 in actuating the selected one of the 3 reed switches to be brought into play. The switches, being normally open circuit devices, come into play in being "closed" when the magnet 33 is in position. A rear sleeve spacer 28 secures the alignment of the cam 29 against undesired movement as might interfere with the operation of the follower 31, to hold the can position laterally. The tie rod 14 holds everything together, with the spacers being of a metal fabrication. When encased in a heavy duty polymer housing 13, and closed at the back with a rear cover 25, the rotary switch of the invention can then be secured with a large rear cover screw 26 (FIG. 1).

Recognizing that a further implementation of an assembly might itself include the relay to connect to the control or pilot device in sending its electrical signals for various operations of equipment of the types by switch handle positionings, the advantage of the magnetic rotary device of the invention avoids the susceptibility of the electro-mechanical constructions which were susceptible to erroneous errors through physical contact wearings that caused its contacts to drift apart. Besides the contacts and followers having a tendency to wear out very easily, such movements undesirably varied the contact gap openings leading to further inconsistent operation and frequent needs to replace the contact tips. Quality issues were always present, with a concomitant suffering of operational longevity. With the invention as described above, the need for complex mechanical cam actions that were previously required to actuate the numbers of levers and contacts employed was significantly overcome, as shown by product testings. The end result is a simpler, more reliable, and longer lasting rotary switch for vehicular wheel and like equipment controls.

While there has been described what is considered to be a preferred embodiment of the present invention, it will readily be appreciated by those skilled in the art that modifications can be made without departing from the scope of the teachings herein. Thus, for example, while a 3-lobe cam could be utilized with the magnetic rotating switch of the invention, particularly for a panel mounting utilization of a cam with additional lobes would allow additional handle adjustments to an operator requiring further adjustment regulation of the vehicle or equipment. A 4-stage switch, or a 5-stage switch could be had in similar manner, as might find usefulness in various locomotive train applications. All that would there be needed then, is the connection of additional reed-type magnetic switch components and interconnections to provide the function desired. Essentially, then, for the 8 lobe cam 29 of FIGS. 1-5 affording angularly positional lobe cuts of 45°, rotations are provided to allow up to 8 handle positions through a 360° rotation for utilizing a like number of magnetic reed switch interconnections in controlling electrically operated wheels, relays, motors and equipment by transferring their needed currents and voltages. For at least such reason, therefore, and for a 3, 4, 5, etc. lobe cam of a like number of angularly spaced positional lobe cuts, resort should be had to the claims appended hereto for a true understanding of the scope of the invention.

We claim:

1. A multi-position rotary switch device comprising:

a plurality of magnetic reed switches;

a cam having a plurality of angularly spaced positional lobe cuts;

a graspable handle angularly rotatable between user selected positions;

a shaft journalled between said cam at one end and said handle at an opposite end;

an arm coupled at one end with said shaft and rotatable therewith; and a magnet at an opposite end of said arm positionably adjustable adjacent individual ones of said magnetic reed switches in accordance with predetermined user angular rotation of said handle;

with said rotary switch device having at least 3 magnetic reed switches and a cam having at least 3 angularly spaced positional lobe cuts;

and with pairs of output conductors coupled with each of said magnetic reed switches.

2. The rotary switch device of claim 1 including 3 magnetic reed switches and a cam having 8 positional lobe cuts of 45° angular spacing.

3. The rotary switch device of claim 1 including means for securing said shaft in position vertically and horizontally.

4. The rotary switch device of claim 3 wherein said means includes an adjustable collar for varying the distance between said arm and each magnetic reed switch.

5. The rotary switch device of claim 4 including means for locking said graspable handle in place at each user rotatable position selected.

6. The rotary switch device of claim 5 wherein said locking means includes means for providing lateral positioning of said graspable handle in limiting the extent of each user rotatable position selected.

7. The rotary switch device of claim 6 including a rear frame support for the switching device and means for locking each positional lobe cut of said cam in accordance with said predetermined user angular rotation of said handle.

8. The rotary switch device of claim 7 wherein said means for locking each positional lobe cut includes a spring to index positioning of each positional lobe cut and to provide tensioning thereto.

9. The rotary switch device of claim 8 wherein said pairs of output conductors couple to individual relays controlling electrically operated wheels, motors and equipment.

10. The rotary switch device of claim 9 including 3 magnetic reed switches and a cam having 8 positional lobe cuts of 45° angular spacing.

* * * * *